US009898952B2

(12) United States Patent
Fujii

(10) Patent No.: US 9,898,952 B2
(45) Date of Patent: Feb. 20, 2018

(54) DATA COMPENSATION DEVICE COMPENSATING DATA BASED ON AVERAGE CURRENT, BUS VOLTAGE DROP INFORMATION, AND ARRAY VOLTAGE DROP INFORMATION AND DISPLAY DEVICE INCLUDING THE SAME

(71) Applicant: Samsung Display Co., LTD., Yongin-si, Gyeonggi-Do (KR)

(72) Inventor: Mitsuru Fujii, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 113 days.

(21) Appl. No.: 14/922,605

(22) Filed: Oct. 26, 2015

(65) Prior Publication Data

US 2016/0307511 A1 Oct. 20, 2016

(30) Foreign Application Priority Data

Apr. 17, 2015 (KR) ..... 10-2015-0054193

(51) Int. Cl.
*G09G 3/30* (2006.01)
*G09G 3/20* (2006.01)
(Continued)

(52) U.S. Cl.
CPC ..... *G09G 3/20* (2013.01); *G09G 3/32* (2013.01); *G09G 2320/0223* (2013.01);
(Continued)

(58) Field of Classification Search
CPC ..... G09G 3/3216; G09G 3/32; G09G 3/20
(Continued)

(56) References Cited

U.S. PATENT DOCUMENTS

2003/0122813 A1* 7/2003 Ishizuki ..... G09G 3/3233 345/211
2004/0183483 A1* 9/2004 Inoue ..... G09G 3/3233 315/366
(Continued)

FOREIGN PATENT DOCUMENTS

KR 1020100068075 A 6/2010
KR 1020110123952 A 11/2011
(Continued)

*Primary Examiner* — Adam J Snyder
(74) *Attorney, Agent, or Firm* — Cantor Colburn LLP

(57) ABSTRACT

A data compensation device includes a current calculator which calculates an average current of each of blocks included in a pixel array based on an input data, a data enable signal, a horizontal synchronization signal and a vertical synchronization signal, a voltage drop info provider which provides a bus voltage drop information of predetermined bus points and an array voltage drop information of predetermined array points, the bus points being included in a power supply bus wiring which is connected to the pixel array, the array points being included in the pixel array, a data compensation circuit configured to provide a compensation data corresponding to the input data based on the average current, the bus voltage drop information and the array voltage drop information, and an adder configured to provide a compensation result data by adding the input data and the compensation data.

20 Claims, 9 Drawing Sheets

(51) Int. Cl.
*G09G 3/10* (2006.01)
*G09G 3/32* (2016.01)

(52) U.S. Cl.
CPC ..... *G09G 2320/0233* (2013.01); *G09G 2320/0285* (2013.01); *G09G 2320/045* (2013.01); *G09G 2360/16* (2013.01)

(58) Field of Classification Search
USPC ..... 345/76, 169.3; 315/169.3
See application file for complete search history.

(56) References Cited

U.S. PATENT DOCUMENTS

2005/0052350 A1* 3/2005 Mizukoshi ..... G09G 3/3233 345/55
2006/0284802 A1* 12/2006 Kohno ..... G09G 3/3225 345/76
2008/0024526 A1* 1/2008 Ko ..... G09G 3/3233 345/690
2010/0103083 A1* 4/2010 Shin ..... G09G 3/3208 345/76
2010/0171774 A1* 7/2010 Mizukoshi ..... G09G 3/3275 345/690
2012/0280970 A1* 11/2012 Kato ..... G09G 3/3291 345/212
2012/0327067 A1* 12/2012 Kato ..... G09G 3/3258 345/212
2013/0009939 A1* 1/2013 Ebisuno ..... G09G 3/3233 345/212
2014/0062989 A1* 3/2014 Ebisuno ..... G09G 3/3241 345/212

FOREIGN PATENT DOCUMENTS

KR 1020120104783 A 9/2012
KR 1020120111675 A 10/2012
KR 1020160047618 A 5/2016
KR 1020160092552 A 8/2016

* cited by examiner

FIG. 3

T11(X) (mV)

| V10 | V20 | V30 | V40 | V50 | V60 | V70 | V80 | V90 |
|---|---|---|---|---|---|---|---|---|
| 50 | 40 | 30 | 30 | 30 | 30 | 30 | 30 | 30 |

FIG. 4

T21(X) (mV)

| V10 | V20 | V30 | V40 | V50 | V60 | V70 | V80 | V90 |
|---|---|---|---|---|---|---|---|---|
| 50 | 50 | 40 | 30 | 30 | 30 | 30 | 30 | 30 |

T91(X) (mV)

| V10 | V20 | V30 | V40 | V50 | V60 | V70 | V80 | V90 |
|---|---|---|---|---|---|---|---|---|
| 30 | 30 | 30 | 30 | 30 | 30 | 30 | 40 | 50 |

DATA COMPENSATION DEVICE COMPENSATING DATA BASED ON AVERAGE CURRENT, BUS VOLTAGE DROP INFORMATION, AND ARRAY VOLTAGE DROP INFORMATION AND DISPLAY DEVICE INCLUDING THE SAME

This application claims priority to Korean Patent Application No. 10-2015-0054193 filed on Apr. 17, 2015, and all the benefits accruing therefrom under 35 U.S.C. §119, the content of which in its entirety is herein incorporated by reference.

BACKGROUND

1. Field

The exemplary embodiments generally relate to a display device, and more particularly to a data compensation device and a display device.

2. Discussion of the Related Art

According to further development of electronic devices, a display device is being developed to have higher performance and higher speed. Various research is in progress to obtain such higher performance.

SUMMARY

One exemplary embodiment is a data compensation device capable of increasing performance by providing a compensation data corresponding to an input data based on an average current, a bus voltage drop information and an array voltage drop information.

Another exemplary embodiment is a display device capable of increasing the performance by providing the compensation data corresponding to the input data based on the average current, the bus voltage drop information and the array voltage drop information.

A data compensation device according to exemplary embodiments includes a current calculator, a voltage drop info provider, a data compensation circuit and an adder. The current calculator calculates an average current of each of blocks included in a pixel array based on an input data, a data enable signal, a horizontal synchronization signal and a vertical synchronization signal. The voltage drop info provider provides a bus voltage drop information of predetermined bus points and an array voltage drop information of predetermined array points. The predetermined bus points are included in a power supply bus wiring that is connected to the pixel array. The predetermined array points are included in the pixel array. The data compensation circuit provides a compensation data corresponding to the input data based on the average current, the bus voltage drop information and the array voltage drop information. The adder provides a compensation result data by adding the input data and the compensation data.

In an exemplary embodiment, the voltage drop info provider may include a first look-up table and a second look-up table. The first look-up table may store the bus voltage drop information of the predetermined bus points included in the power supply bus wiring. The second look-up table may store the array voltage drop information of the predetermined array points included in the pixel array.

In an exemplary embodiment, the bus voltage drop information may be a voltage drop value of the predetermined bus points by a unit current that is provided to each of the blocks. The array voltage drop information may be a voltage drop value of the predetermined array points by the unit current that is provided to each of the blocks.

In an exemplary embodiment, the data compensation circuit may include a voltage drop calculator, an interpolator and a data compensator. The voltage drop calculator may calculate a block voltage drop value of each of the blocks based on the average current, the bus voltage drop information and the array voltage drop information. The interpolator may calculate a pixel voltage drop value of each of pixels included in each of the blocks according to the block voltage drop value. The data compensator may provide the compensation data compensating the input data corresponding to each of the pixels based on the pixel voltage drop value.

In an exemplary embodiment, the voltage drop calculator may calculate a bus voltage drop value that is a voltage drop in the predetermined bus points based on the average current and the bus voltage drop information.

In an exemplary embodiment, the voltage drop calculator may calculate an array voltage drop value that is a voltage drop in the predetermined array points based on the average current and the array voltage drop information.

In an exemplary embodiment, the block voltage drop value may be a sum of the bus voltage drop value and the array voltage drop value.

In an exemplary embodiment, the voltage drop calculator may include a block voltage drop register storing the block voltage drop value.

In an exemplary embodiment, the interpolator may calculate the pixel voltage drop value of each of the pixels included in adjacent blocks based on the block voltage drop value of the adjacent blocks among the blocks.

In an exemplary embodiment, the current calculator may include an average current calculation circuit and an average current register. The average current calculation circuit may calculate the average current of each of the blocks. The average current register may store the average current.

In an exemplary embodiment, the average current may be updated based on the vertical synchronization signal.

In an exemplary embodiment, the average current may be updated each frame that is determined according to the vertical synchronization signal.

In an exemplary embodiment, the data compensator may include a reference value provider and a compensation circuit. The reference value provider may provide a reference voltage drop value of each of the pixels included in the blocks. The compensation circuit may provide the compensation data based on the pixel voltage drop value and the reference voltage drop value.

In an exemplary embodiment, the reference value provider may include a reference look-up table storing the reference voltage drop value.

In an exemplary embodiment, the reference voltage drop value may be stored in the reference look-up table before the data compensation device operates.

In an exemplary embodiment, the compensation data may correspond to a difference between the pixel voltage drop value and the reference voltage drop value.

In an exemplary embodiment, the blocks may be determined based on a number of pixels included in the pixel array.

A display device according to exemplary embodiments includes a current calculator, a voltage drop info provider, a data compensation circuit, an adder and a pixel array. The current calculator calculates an average current of each of blocks included in a pixel array based on an input data, a data enable signal, a horizontal synchronization signal and a vertical synchronization signal. The voltage drop info provider provides a bus voltage drop information of predetermined bus points and an array voltage drop information of predetermined array points. The predetermined bus points are included in a power supply bus wiring that is connected to the pixel array. The predetermined array points are included in the pixel array. The data compensation circuit provides a compensation data corresponding to the input data based on the average current, the bus voltage drop information and the array voltage drop information. The adder provides a compensation result data by adding the input data and the compensation data. The pixel array displays the compensation data.

In an exemplary embodiment, the voltage drop info provider may include a first look-up table and a second look-up table. The first look-up table may store the bus voltage drop information of the predetermined bus points included in the power supply bus wiring. The second look-up table may store the array voltage drop information of the predetermined array points included in the pixel array. The bus voltage drop information and the array voltage drop information may be stored in the first look-up table and the second look-up table before the display device operates.

In an exemplary embodiment, the data compensation circuit may include a voltage drop calculator, an interpolator and a data compensator. The voltage drop calculator may calculate a block voltage drop value of each of the blocks based on the average current, the bus voltage drop information and the array voltage drop information. The interpolator may calculate a pixel voltage drop value of each of pixels included in each of the blocks according to the block voltage drop value. The data compensator may provide the compensation data compensating the input data corresponding to each of the pixels based on the pixel voltage drop value.

In an exemplary embodiment, the data compensation device may increase the performance by providing the compensation data corresponding to the input data based on the average current, the bus voltage drop information and the array voltage drop information.

BRIEF DESCRIPTION OF THE DRAWINGS

Exemplary embodiments, advantages and features of the invention will be more clearly understood from the following detailed description taken in conjunction with the accompanying drawings, in which:

FIG. 3 is a diagram illustrating an exemplary embodiment of bus voltage drop information corresponding to the power supply bus wiring of FIG. 2.

FIG. 4 is a diagram illustrating another exemplary embodiment of bus voltage drop information corresponding to the power supply bus wiring of FIG. 2.

DETAILED DESCRIPTION

Figure 1:
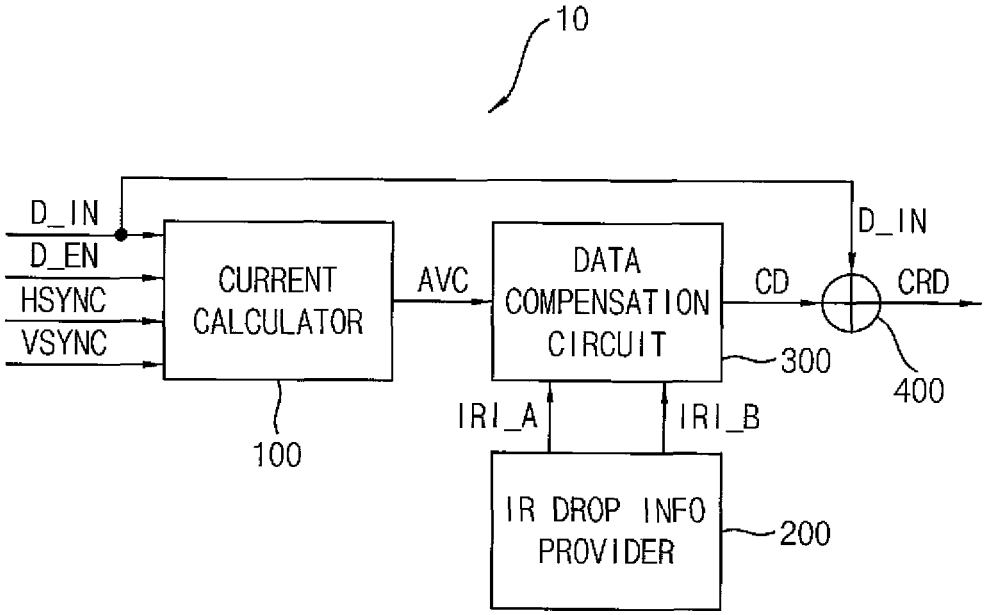
FIG. 1 is a block diagram illustrating a data compensation device according to exemplary embodiments.

The exemplary embodiments are described more fully hereinafter with reference to the accompanying drawings. Like or similar reference numerals refer to like or similar elements throughout.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Figure 2:
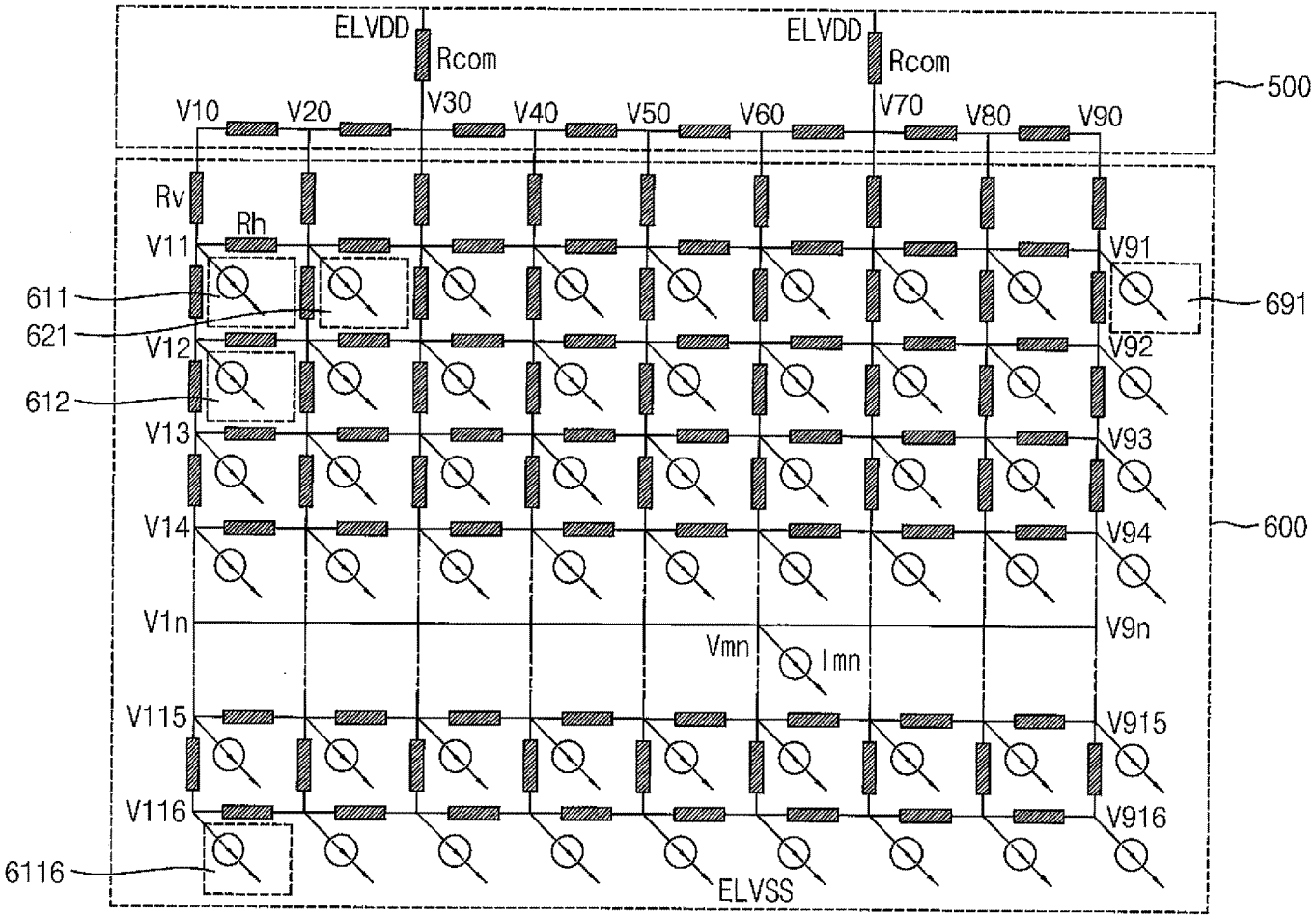
FIG. 2 is a diagram illustrating a power supply bus wiring and a pixel array of a display device including the data compensation device of FIG. 1.

FIG. 1 is a block diagram illustrating a data compensation device according to exemplary embodiments and FIG. 2 is a diagram illustrating a power supply bus wiring and a pixel array of a display device including the data compensation device of FIG. 1.

Referring to FIGS. 1 and 2, a data compensation device 10 includes a current calculator 100, a voltage drop info provider (also referred to as "IR drop info provider") 200, a data compensation circuit 300 and an adder 400. The current calculator 100 calculates an average current AVC of each of blocks 611, 612, 621 . . . 691 included in a pixel array 600 based on an input data D_IN, a data enable signal D_EN, a horizontal synchronization signal HSYNC and a vertical synchronization signal VSYNC. In an exemplary embodiment, the pixel array 600 may include 1080*1920 pixels, for example. In case the pixel array 600 includes 1080*1920 pixels, one block may include 120*120 pixels, for example. In case the pixel array 600 includes 1080*1920 pixels and the one block includes 120*120 pixels, a number of the blocks 611, 612, 621 . . . 691 included in the pixel array 600 may be 9*16, for example. In an exemplary embodiment, the average current AVC of a first block 611 may be calculated based on the input data D_IN corresponding to the first block 611, for example. The horizontal synchronization signal HSYNC and the vertical synchronization signal VSYNC may be used to divide the input data D_IN corresponding to the first block 611. In addition, the average current AVC of a second block 621 may be calculated based on the input data D_IN corresponding to the second block 621. In the same manner, the average current AVC of a ninth block 691 may be calculated based on the input data D_IN corresponding to the ninth block 691. In an exemplary embodiment, the average current AVC of the blocks 611, 612, 621, . . . , 691 may be updated each frame.

The voltage drop info provider 200 provides a bus voltage drop information IRI_B of predetermined bus points V10, . . . , V90 and an array voltage drop information IRI_A of predetermined array points V11 TO V116, . . . , V91 TO V916. The bus points V10, . . . , V90 are included in a power supply bus wiring 500 that is connected to the pixel array 600. The array points V11 TO V116, . . . , V91 TO V916 are included in the pixel array 600. In an exemplary embodiment, the predetermined bus points may include a first to ninth bus points V10, . . . , V90, for example. The information of the voltage drop in the first to ninth bus points V10, . . . , V90 may be the bus voltage drop information IRI_B. The predetermined array points may include a first to 916-th array points V11 TO V116, . . . , V91 TO V916. The information of the voltage drop in the first to 916-th array points V11 TO V116, . . . , V91 TO V916 may be the array voltage drop information IRI_A. The voltage drop of each point of the pixel array 600 may be calculated using the bus voltage drop information IRI_B and the array voltage drop information IRI_A.

The data compensation circuit 300 provides a compensation data CD corresponding to the input data D_IN based on the average current AVC, the bus voltage drop information IRI_B and the array voltage drop information IRI_A. The adder 400 provides a compensation result data CRD by adding the input data D_IN and the compensation data CD. The data compensation device 10 according to exemplary embodiments may increase the performance by providing the compensation data CD corresponding to the input data D_IN based on the average current AVC, the bus voltage drop information IRI_B and the array voltage drop information IRI_A.

Figures 5, 6:
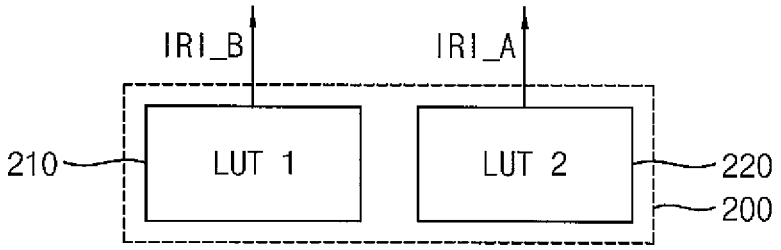
FIG. 5 is a diagram illustrating another exemplary embodiment of bus voltage drop information corresponding to the power supply bus wiring of FIG. 2.
FIG. 6 is a block diagram illustrating an exemplary embodiment of a voltage drop info provider included in the data compensation device of FIG. 1.

FIG. 3 is a diagram illustrating an example of bus voltage drop information corresponding to the power supply bus wiring of FIG. 2, FIG. 4 is a diagram illustrating another example of bus voltage drop information corresponding to the power supply bus wiring of FIG. 2, FIG. 5 is a diagram illustrating still another example of bus voltage drop information corresponding to the power supply bus wiring of FIG. 2 and FIG. 6 is a block diagram illustrating an example of a voltage drop info provider included in the data compensation device of FIG. 1.

Referring to FIGS. 3 to 6, the voltage drop info provider 200 may include a first look-up table 210 and a second look-up table 220. The first look-up table 210 may store the bus voltage drop information IRI_B of the bus points V10, . . . , V90 included in the power supply bus wiring 500. In an exemplary embodiment, a unit current may be only provided to the first block 611 among the blocks 611, 612, 621 . . . 691 included in the pixel array 600. In case the unit current is provided to the first block 611, the voltage drop value in the first bus point V10 may be about 50 millivolts (mV), for example. In addition, in case the unit current is provided to the first block 611, the voltage drop value in the second bus point V20 may be about 40 mV, for example. In addition, in case the unit current is provided to the first block 611, the voltage drop value in the third to ninth bus points V30, . . . , V90 may be about 30 mV, for example. In this case, the voltage drop values in the first to ninth bus points V10, . . . , V90 may be included in the bus voltage drop information IRI_B. The bus voltage drop information IRI_B that is the voltage drop value in the first to ninth bus points V10, . . . , V90 in case the unit current is provided to the first block 611 may be stored in the first look-up table 210.

In an exemplary embodiment, the unit current may be only provided to the second block 621 among the blocks 611, 612, 621 . . . 691 included in the pixel array 600. In case the unit current is provided to the second block 621, the voltage drop value in the first bus point V10 may be about 50 mV, for example. In addition, in case the unit current is provided to the second block 621, the voltage drop value in the second bus point V20 may be about 50 mV, for example. In addition, in case the unit current is provided to the second block 621, the voltage drop value in the third bus point V30 may be about 40 mV, for example. In addition, in case the unit current is provided to the second block 621, the voltage drop value in the fourth to ninth bus points V40, . . . , V90 may be about 30 mV, for example. In this case, the voltage drop values in the first to ninth bus points V10, . . . , V90 may be included in the bus voltage drop information IRI_B. The bus voltage drop information IRI_B that is the voltage drop value in the first to ninth bus points V10, . . . , V90 in case the unit current is provided to the second block 621 may be stored in the first look-up table 210.

In the same manner, the voltage drop values in the first to ninth bus points V10, . . . , V90 may be calculated after the unit current is provided to one of the blocks 611, 612, 621 . . . 691 included in the pixel array 600. The voltage drop values in the first to ninth bus points V10, . . . , V90 that are calculated after the unit current is provided to one of the blocks 611, 612, 621 . . . 691 included in the pixel array 600 may be stored in the first look-up table 210.

The second look-up table 220 may store the array voltage drop information IRI_A of the array points V11 TO V116, . . . , V91 TO V916 included in the pixel array 600. The array voltage drop information IRI_A may be calculated based on the same manner as the bus voltage drop information IRI_B. In an exemplary embodiment, the voltage drop values in the first to 916-th array points V11 TO V116, . . . , V91 TO V916 may be calculated after the unit current is provided to one of the blocks 611, 612, 621 . . . 691 included in the pixel array 600, for example. The voltage drop values in the first to 916-th array points V11 TO V116, . . . , V91 TO V916 that are calculated after the unit current is provided to one of the blocks 611, 612, 621 . . . 691 included in the pixel array 600 may be stored in the second look-up table 220.

In an exemplary embodiment, the bus voltage drop information IRI_B may be a voltage drop value of the bus points V10, . . . , V90 by a unit current that is provided to each of the blocks 611, 612, 621 . . . 691. The array voltage drop information IRI_A may be a voltage drop value of the array points V11 TO V116, . . . , V91 TO V916 by the unit current that is provided to each of the blocks 611, 612, 621 . . . 691.

Figure 7:
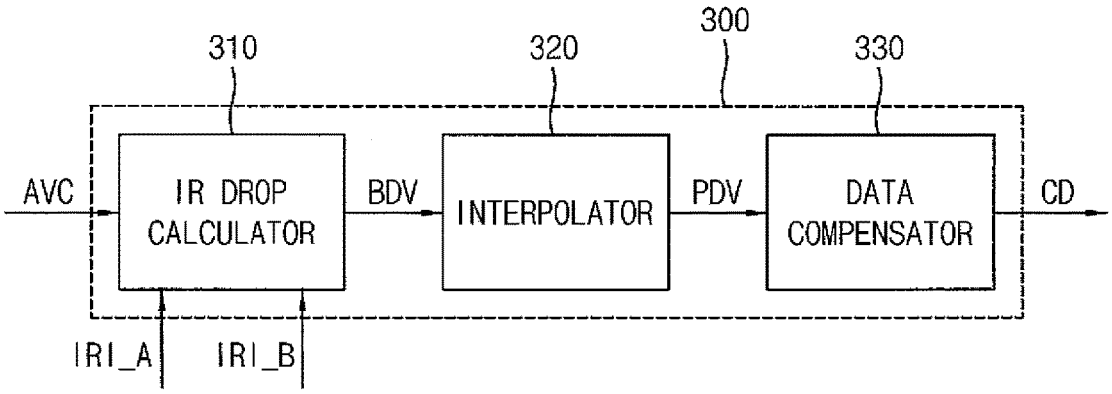
FIG. 7 is a block diagram illustrating an exemplary embodiment of a data compensation circuit included in the data compensation device of FIG. 1.

FIG. 7 is a block diagram illustrating an example of a data compensation circuit included in the data compensation device of FIG. 1.

Referring to FIG. 7, the data compensation circuit 300 may include a voltage drop calculator (also referred to as "IR drop calculator") 310, an interpolator 320 and a data compensator 330. The voltage drop calculator 310 may calculate a block voltage drop value BDV of each of the blocks 611, 612, 621 . . . 691 based on the average current AVC, the bus voltage drop information IRI_B and the array voltage drop information IRI_A. In an exemplary embodiment, as a multiplication of the average current AVC and the bus voltage drop information IRI_B is increased, the block voltage drop value BDV may be increased, for example. As a multiplication of the average current AVC and the bus voltage drop information IRI_B is decreased, the block voltage drop value BDV may be decreased.

$$\text{Vtop_drop}(x) = Rt \times \sum_m \sum_n Imn \times Tmn(x) \qquad \text{[math equation 1]}$$

Where Vtop_drop(x) is voltage drop of the power supply bus wring in x position, Rt is a resistor constant, Imn is current of the block that is determined by m, n, Tmn(x) is voltage drop of the power supply bus wring in x position when the unit current is provided to the block that is determined by m, n. (e.g., m=1, 2 . . . , 9, n=1, 2 . . . , 16, x=1, 2 . . . , 9)

$$Vdrop(x, y) = \text{Vtop_drop}(x) + Rs \times \sum_m \sum_n Imn \times Smn(x, y) \times Yn \qquad \text{[math equation 2]}$$

Where Vdrop(x, y) is voltage drop in (x, y) position, Rs is a resistor constant, Smn(x, y) is value of normalizing a difference between the voltage drop in (x, y) position and the voltage drop of the power supply bus wring in x position when the unit current is provided to the block that is determined by m, n. When n is less than y, Yn may be n. When n is equal to or greater than y, Yn may be y.

The interpolator 320 may calculate a pixel voltage drop value PDV of each of pixels included in each of the blocks 611, 612, 621 . . . 691 according to the block voltage drop value BDV. In an exemplary embodiment, the pixel array 600 may include 1080*1920 pixels. In case the pixel array 600 includes 1080*1920 pixels, one block may include 120*120 pixels, for example. In case the pixel array 600 includes 1080*1920 pixels and the one block includes 120*120 pixels, the number of the blocks 611, 612, 621 . . . 691 included in the pixel array 600 may be 9*16. The block voltage drop value BDV may be the voltage drop value in point corresponding to each of the blocks 611, 612, 621 . . . 691. The pixel voltage drop value PDV of each of pixels included in each of the blocks 611, 612, 621 . . . 691 may be calculated using the block voltage drop value BDV corresponding to the blocks 611, 612, 621 . . . 691.

The data compensator 330 may provide the compensation data CD compensating the input data D_IN corresponding to each of the pixels based on the pixel voltage drop value PDV. In an exemplary embodiment, the data compensator 330 may generate the compensation data CD compensating the input data D_IN corresponding to each of the pixels using the pixel voltage drop value PDV that is the voltage drop value of the pixels included in the blocks 611, 612, 621 . . . 691, for example.

In an exemplary embodiment, the voltage drop calculator 310 may calculate a bus voltage drop value that is a voltage drop in the bus points V10, . . . , V90 based on the average current AVC and the bus voltage drop information IRI_B. The voltage drop calculator 310 may calculate an array voltage drop value that is a voltage drop in the array points V11 TO V116, . . . , V91 TO V916 based on the average current AVC and the array voltage drop information IRI_A. In an exemplary embodiment, the block voltage drop value BDV may be a sum of the bus voltage drop value and the array voltage drop value. In an exemplary embodiment, the bus voltage drop value in the first bus point V10 may be about 20 mV, for example. The array voltage drop value from the first bus point V10 to the first array point V11 may be about 30 mV. In case the bus voltage drop value in the first bus point V10 is about 20 mV and the array voltage drop value from the first bus point V10 to the first array point V11 is about 30 mV, the block voltage drop value BDV in the first block 611 may be about 50 mV. In an exemplary embodiment, the bus voltage drop value in the second bus point V20 may be about 10 mV, for example. The array voltage drop value from the second bus point V20 to the second array point V21 may be about 30 mV. In case the bus voltage drop value in the second bus point V20 is about 10 mV and the array voltage drop value from the second bus point V20 to the second array point V21 is about 30 mV, the block voltage drop value BDV in the second block 621 may be about 40 mV. In an exemplary embodiment, the bus voltage drop value in the first bus point V10 may be about 20 mV, for example. The array voltage drop value from the first bus point V10 to the third array point V12 may be about 40 mV. In case the bus voltage drop value in the first bus point V10 is about 20 mV and the array voltage drop value from the first bus point V10 to the third array point V12 is about 40 mV, the block voltage drop value BDV in the third block 612 may be about 60 mV.

Figure 8:
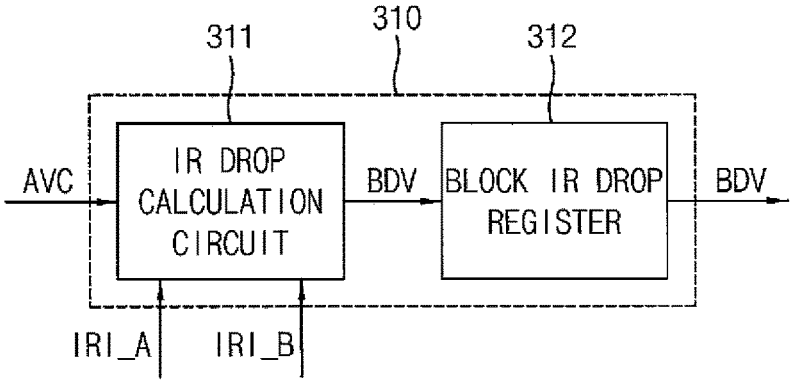
FIG. 8 is a block diagram illustrating an exemplary embodiment of a voltage drop calculator included in the data compensation circuit of FIG. 7.

FIG. 8 is a block diagram illustrating an example of a voltage drop calculator included in the data compensation circuit of FIG. 7.

Referring to FIG. 8, the voltage drop calculator 310 may include a voltage drop calculation circuit (also referred to as "IR drop calculation circuit") 311 and a block voltage drop register 312. The voltage drop calculation circuit 311 may calculate the block voltage drop value BDV of each of the blocks 611, 612, 621 . . . 691 based on the average current AVC, the bus voltage drop information IRI_B and the array voltage drop information IRI_A.

In an exemplary embodiment, the voltage drop calculator 310 may include the block voltage drop register 312 storing the block voltage drop value BDV. In an exemplary embodiment, the block voltage drop value BDV in the first block 611 may be about 50 mV, the block voltage drop value BDV in the second block 621 may be about 40 mV and the block voltage drop value BDV in the third block 612 may be about 60 mV, for example. The block voltage drop value BDV in the first block 611, the block voltage drop value BDV in the second block 621 and the block voltage drop value BDV in the third block 612 may be stored in the block voltage drop register (also referred to as "IR voltage drop register") 312.

Figure 9:
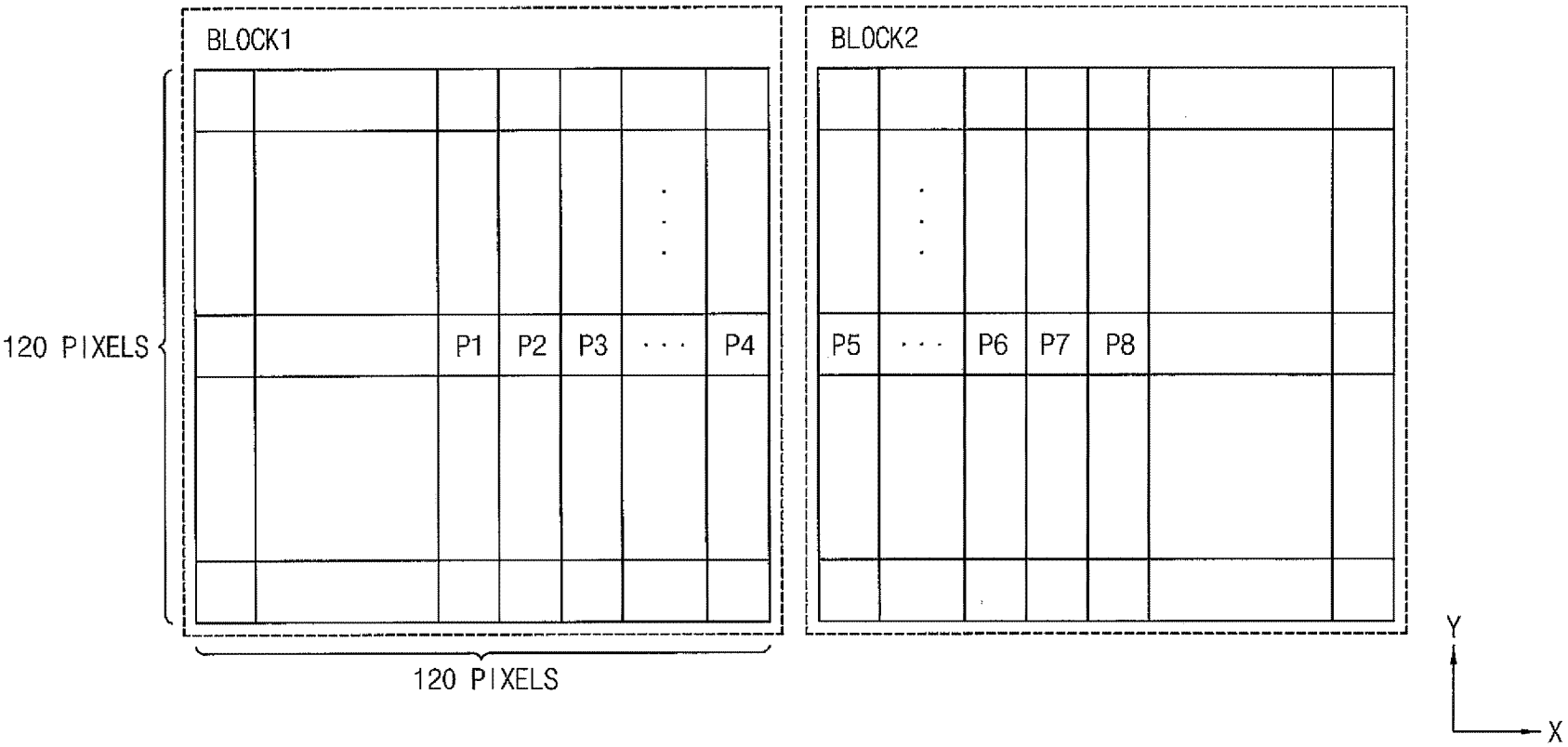
FIG. 9 is a diagram for describing an exemplary embodiment of an operation of an interpolator included in the data compensation circuit of FIG. 7.

FIG. 9 is a diagram for describing an operation example of an interpolator included in the data compensation circuit of FIG. 7.

Referring to FIGS. 7 and 9, the interpolator 320 may calculate the pixel voltage drop value PDV of each of the pixels included in adjacent blocks 611, 612, 621 . . . 691 (refer to FIG. 2) based on the block voltage drop value BDV of the adjacent blocks 611, 612, 621 . . . 691 among the blocks 611, 612, 621 . . . 691. In an exemplary embodiment, the first block 611 may include a first pixel P1, a second pixel P2, a third pixel P3 and a fourth pixel P4, for example. The second block 621 may include a fifth pixel P5, a sixth pixel P6, a seventh pixel P7 and an eighth pixel P8. The second block 621 may be placed from the first block 611 in X direction. The second block 621 may be the adjacent block to the first block 611. In an exemplary embodiment, the block voltage drop value BDV in the first block 611 may be about 50 mV and the block voltage drop value BDV in the second block 621 may be about 40 mV, for example. In this case, the pixel voltage drop value PDV of each of the pixels included in adjacent blocks 611, 612, 621 . . . 691 may be calculated based on the block voltage drop value BDV of the adjacent blocks 611, 612, 621 . . . 691 among the blocks 611, 612, 621 . . . 691. In an exemplary embodiment, the pixel voltage drop value PDV in the first pixel P1 included in the first block 611 may be about 50 mV, for example. In addition, the pixel voltage drop value PDV in the eighth pixel P8 included in the second block 621 may be about 40 mV, for example. In case the pixel voltage drop value PDV in the first pixel P1 included in the first block 611 is about 50 mV and the pixel voltage drop value PDV in the eighth pixel P8 included in the second block 621 is about 40 mV, the pixel voltage drop value PDV in the second pixel P2 included in the first block 611 may be about 49.5 mV, for example. In addition, in case the pixel voltage drop value PDV in the first pixel P1 included in the first block 611 is about 50 mV and the pixel voltage drop value PDV in the eighth pixel P8 included in the second block 621 is about 40 mV, the pixel voltage drop value PDV in the fourth pixel P4 included in the first block 611 may be about 45 mV, for example. In addition, in case the pixel voltage drop value PDV in the first pixel P1 included in the first block 611 is about 50 mV and the pixel voltage drop value PDV in the eighth pixel P8 included in the second block 621 is about 40 mV, the pixel voltage drop value PDV in the fifth pixel P5 included in the second block 621 may be about 45 mV, for example. In addition, in case the pixel voltage drop value PDV in the first pixel P1 included in the first block 611 is about 50 mV and the pixel voltage drop value PDV in the eighth pixel P8 included in the second block 621 is about 40 mV, the pixel voltage drop value PDV in the seventh pixel P7 included in the second block 621 may be about 40.5 mV, for example.

Figure 10:
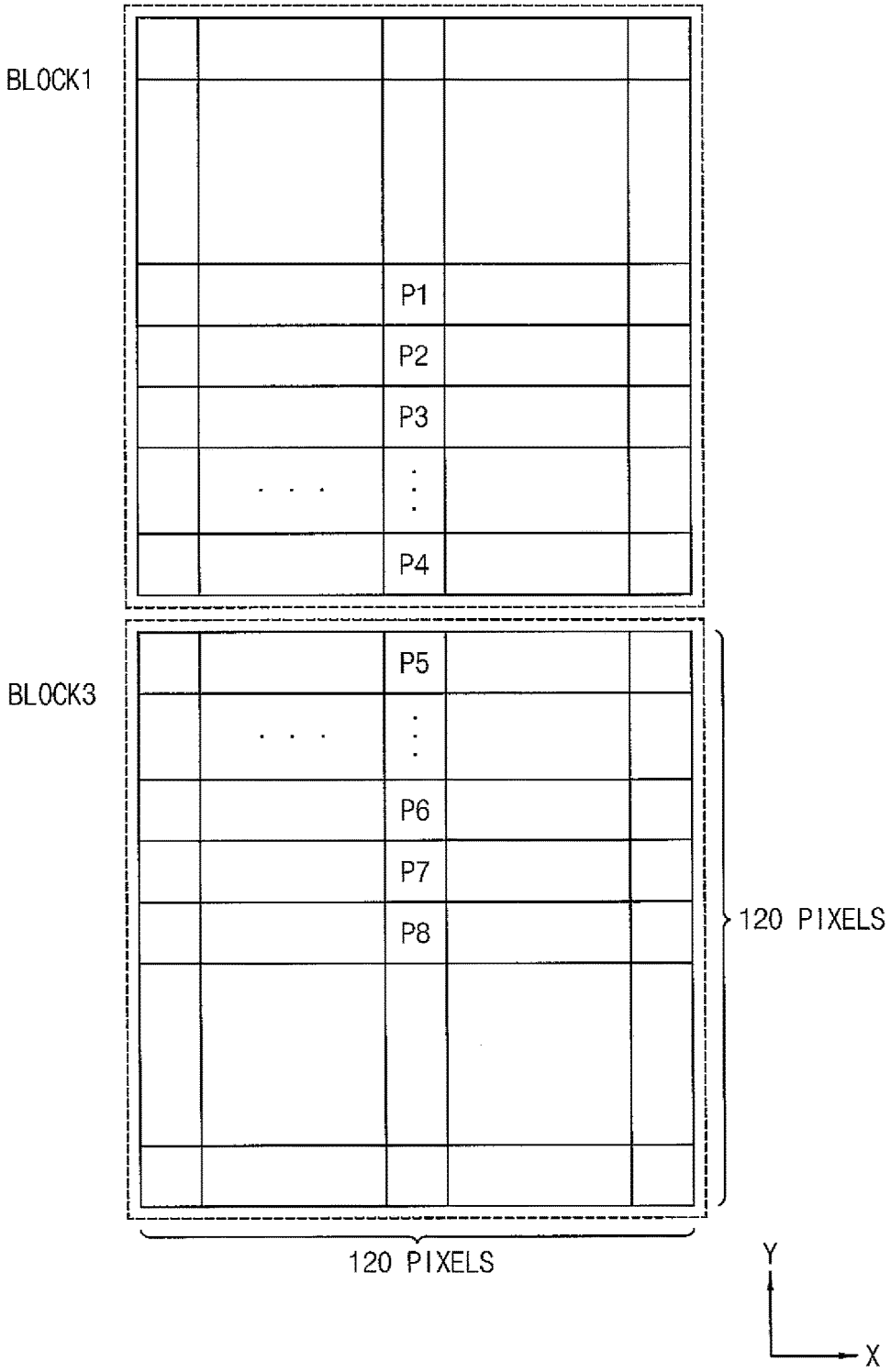
FIG. 10 is a diagram for describing another exemplary embodiment of an operation of an interpolator included in the data compensation circuit of FIG. 7.

FIG. 10 is a diagram for describing another operation example of an interpolator included in the data compensation circuit of FIG. 7.

Referring to FIGS. 7 and 10, the interpolator 320 may calculate the pixel voltage drop value PDV of each of the pixels included in adjacent blocks based on the block voltage drop value BDV of the adjacent blocks among the blocks 611, 612, 621 . . . 691 (refer to FIG. 2). In an exemplary embodiment, the first block 611 may include a first pixel P1, a second pixel P2, a third pixel P3 and a fourth pixel P4, for example. The third block 612 may include a fifth pixel P5, a sixth pixel P6, a seventh pixel P7 and an eighth pixel P8. The third block 612 may be placed from the first block 611 in Y direction. The third block 612 may be the adjacent block to the first block 611, for example. In an exemplary embodiment, the block voltage drop value BDV in the first block 611 may be about 50 mV and the block voltage drop value BDV in the third block 612 may be about 60 mV, for example. In this case, the pixel voltage drop value PDV of each of the pixels included in adjacent blocks may be calculated based on the block voltage drop value BDV of the adjacent blocks among the blocks 611, 612, 621 . . . 691. In an exemplary embodiment, the pixel voltage drop value PDV in the first pixel P1 included in the first block 611 may be about 50 mV, for example. In addition, the pixel voltage drop value PDV in the eighth pixel P8 included in the third block 612 may be about 60 mV, for example. In case the pixel voltage drop value PDV in the first pixel P1 included in the first block 611 is about 50 mV and the pixel voltage drop value PDV in the eighth pixel P8 included in the third block 612 is about 60 mV, the pixel voltage drop value PDV in the second pixel P2 included in the first block 611 may be about 50.5 mV, for example. In addition, in case the pixel voltage drop value PDV in the first pixel P1 included in the first block 611 is about 50 mV and the pixel voltage drop value PDV in the eighth pixel P8 included in the third block 612 is about 60 mV, the pixel voltage drop value PDV in the fourth pixel P4 included in the first block 611 may be about 55 mV, for example. In addition, in case the pixel voltage drop value PDV in the first pixel P1 included in the first block 611 is about 50 mV and the pixel voltage drop value PDV in the eighth pixel P8 included in the third block 612 is about 60 mV, the pixel voltage drop value PDV in the fifth pixel P5 included in the third block 612 may be about 55 mV, for example. In addition, in case the pixel voltage drop value PDV in the first pixel P1 included in the first block 611 is about 50 mV and the pixel voltage drop value PDV in the eighth pixel P8 included in the third block 612 is about 60 mV, the pixel voltage drop value PDV in the seventh pixel P7 included in the third block 612 may be about 59.5 mV, for example.

Figure 11:
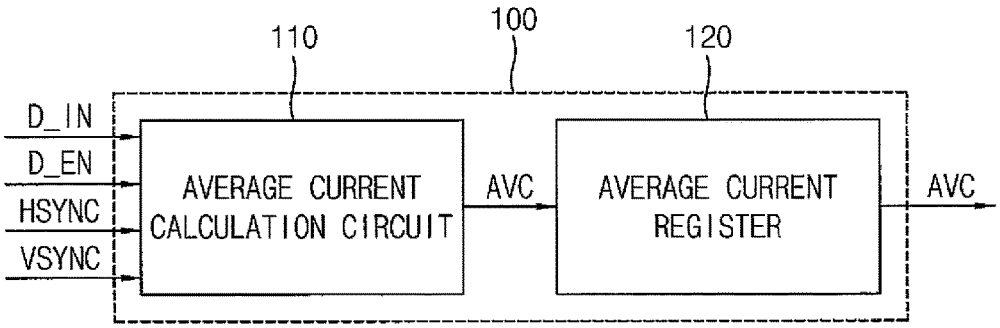
FIG. 11 is a block diagram illustrating an exemplary embodiment of a current calculator included in the data compensation device of FIG. 1.

FIG. 11 is a block diagram illustrating an example of a current calculator included in the data compensation device of FIG. 1.

Referring to FIG. 11, the current calculator 100 may include an average current calculation circuit 110 and an average current register 120. The average current calculation circuit 110 may calculate the average current AVC of each of the blocks 611, 612, 621 . . . 691 (refer to FIG. 2). The average current register 120 may store the average current AVC.

In an exemplary embodiment, the average current AVC may be updated based on the vertical synchronization signal VSYNC, for example. In an exemplary embodiment, the average current AVC may be updated each frame that is determined according to the vertical synchronization signal VSYNC, for example.

Figure 12:
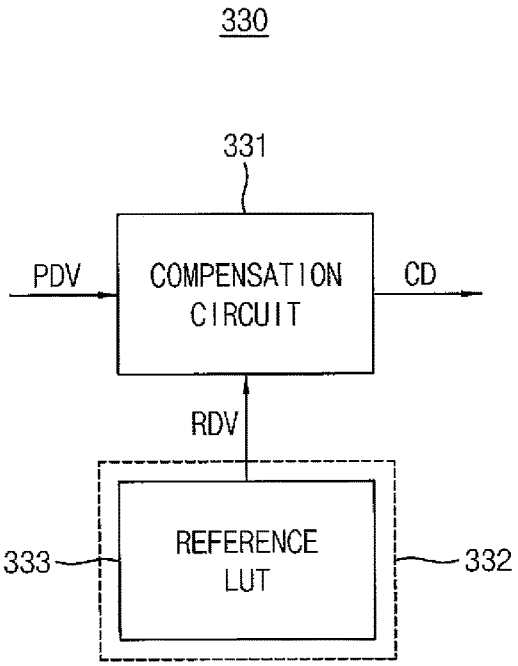
FIG. 12 is a block diagram illustrating an exemplary embodiment of a data compensator included in the data compensation circuit of FIG. 7.

FIG. 12 is a block diagram illustrating an example of a data compensator included in the data compensation circuit of FIG. 7.

Referring to FIG. 12, the data compensator 330 may include a reference value provider 332 and a compensation circuit 331. The reference value provider 332 may provide a reference voltage drop value RDV of each of the pixels included in the blocks 611, 612, 621 . . . 691. The compensation circuit 331 may provide the compensation data CD based on the pixel voltage drop value PDV and the reference voltage drop value RDV.

In an exemplary embodiment, the reference value provider 332 may include a reference look-up table 333 storing the reference voltage drop value RDV. In an exemplary embodiment, the reference voltage drop value RDV may be stored in the reference look-up table 333 before the data compensation device 10 operates, for example.

In an exemplary embodiment, the compensation data CD may correspond to a difference between the pixel voltage drop value PDV and the reference voltage drop value RDV. In an exemplary embodiment, the pixel voltage drop value PDV may be 50 and the reference voltage drop value RDV may be 49, for example. In case the pixel voltage drop value PDV is 50 and the reference voltage drop value RDV is 49, the difference between the pixel voltage drop value PDV and the reference voltage drop value RDV may be 1. In case the difference between the pixel voltage drop value PDV and the reference voltage drop value RDV is 1, the compensation data CD may be data corresponding to the difference.

In an exemplary embodiment, the blocks 611, 612, 621 . . . 691 may be determined based on a number of pixels included in the pixel array 600. In an exemplary embodiment, the pixel array 600 may include 1080*1920 pixels, for example. In case the pixel array 600 includes 1080*1920 pixels, one block may include 120*120 pixels, for example. In case the pixel array 600 includes 1080*1920 pixels and the one block includes 120*120 pixels, the number of the blocks 611, 612, 621 . . . 691 included in the pixel array 600 may be 9*16, for example.

Figure 13:
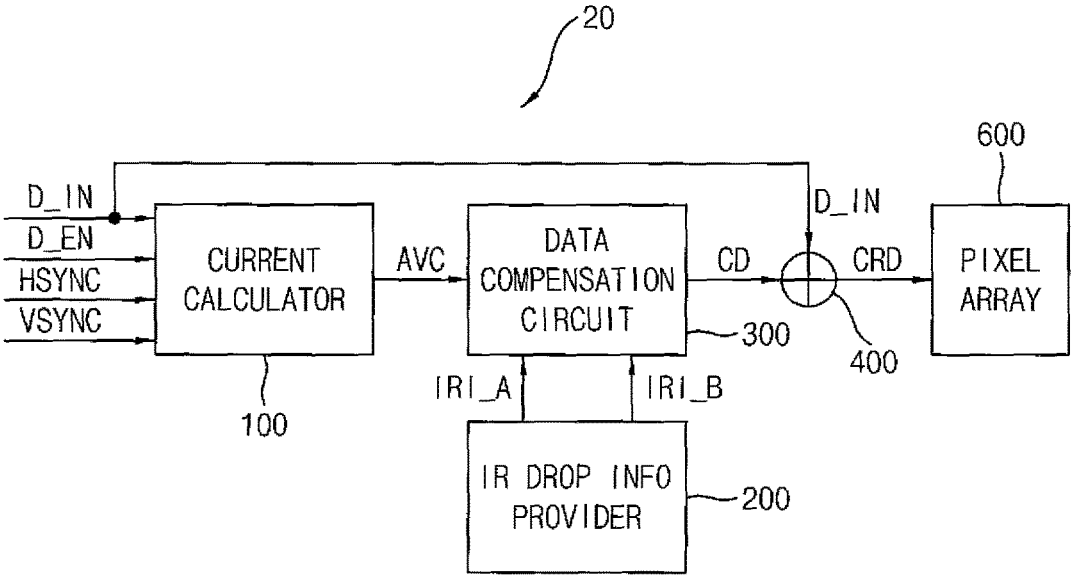
FIG. 13 is a block diagram illustrating exemplary embodiments of a display device according to the invention.

FIG. 13 is a block diagram illustrating a display device according to exemplary embodiments.

Referring to FIG. 13, a display device 20 includes a current calculator 100, a voltage drop info provider 200, a data compensation circuit 300, an adder 400 and a pixel array 600. The current calculator 100 calculates an average current AVC of each of blocks 611, 612, 621 . . . 691 (refer to FIG. 2) included in a pixel array 600 based on an input data D_IN, a data enable signal D_EN, a horizontal synchronization signal HSYNC and a vertical synchronization signal VSYNC. In an exemplary embodiment, the average current AVC of a first block 611 may be calculated based on the input data D_IN corresponding to the first block 611, for example. The horizontal synchronization signal HSYNC and the vertical synchronization signal VSYNC may be used to divide the input data D_IN corresponding to the first block 611. In addition, the average current AVC of a second block 621 may be calculated based on the input data D_IN corresponding to the second block 621. In the same manner, the average current AVC of a ninth block 691 may be calculated based on the input data D_IN corresponding to the ninth block 691. In an exemplary embodiment, the average current AVC of the blocks 611, 612, 621 . . . 691 may be updated each frame.

The voltage drop info provider 200 provides a bus voltage drop information IRI_B of predetermined bus points V10, . . . , V90 and an array voltage drop information IRI_A of predetermined array points V11 TO V116, . . . , V91 TO V916 (refer to FIG. 2). The bus points V10, . . . , V90 are included in a power supply bus wiring 500 that is connected to the pixel array 600. The array points V11 TO V116, . . . , V91 TO V916 are included in the pixel array 600. In an exemplary embodiment, the predetermined bus points may include a first to ninth bus points V10, . . . , V90, for example. The information of the voltage drop in the first to ninth bus points V10, . . . , V90 may be the bus voltage drop information IRI_B. The predetermined array points may include a first to 916-th array points V11 TO V116, . . . , V91 TO V916. The information of the voltage drop in the first to 916-th array points V11 TO V116, . . . , V91 TO V916 may be the array voltage drop information IRI_A. The voltage drop of each point of the pixel array 600 may be calculated using the bus voltage drop information IRI_B and the array voltage drop information IRI_A. In an exemplary embodiment, the voltage drop info provider 200 may include a first look-up table 210 and a second look-up table 220. The first look-up table 210 may store the bus voltage drop information IRI_B of the bus points V10, . . . , V90 included in the power supply bus wiring 500. The second look-up table 220 may store the array voltage drop information IRI_A of the array points V11 TO V116, . . . , V91 TO V916 included in the pixel array 600. The bus voltage drop information and the array voltage drop information IRI_A may be stored in the first look-up table 210 and the second look-up table 220 before the display device 20 operates.

The data compensation circuit 300 provides a compensation data CD corresponding to the input data D_IN based on the average current AVC, the bus voltage drop information IRI_B and the array voltage drop information IRI_A. The adder 400 provides a compensation result data CRD by adding the input data D_IN and the compensation data CD. The pixel array 600 displays the compensation result data CRD. In an exemplary embodiment, the data compensation circuit 300 may include a voltage drop calculator 310, an interpolator 320 and a data compensator 330. The voltage drop calculator 310 may calculate a block voltage drop value BDV of each of the blocks 611, 612, 621 . . . 691 based on the average current AVC, the bus voltage drop information IRI_B and the array voltage drop information IRI_A. The interpolator 320 may calculate a pixel voltage drop value PDV of each of pixels included in each of the blocks 611, 612, 621 . . . 691 according to the block voltage drop value BDV. The data compensator 330 may provide the compensation data CD compensating the input data D_IN corresponding to each of the pixels based on the pixel voltage drop value PDV.

The display device 20 may increase the performance by providing the compensation data CD corresponding to the input data D_IN based on the average current AVC, the bus voltage drop information IRI_B and the array voltage drop information IRI_A.

Figure 14:
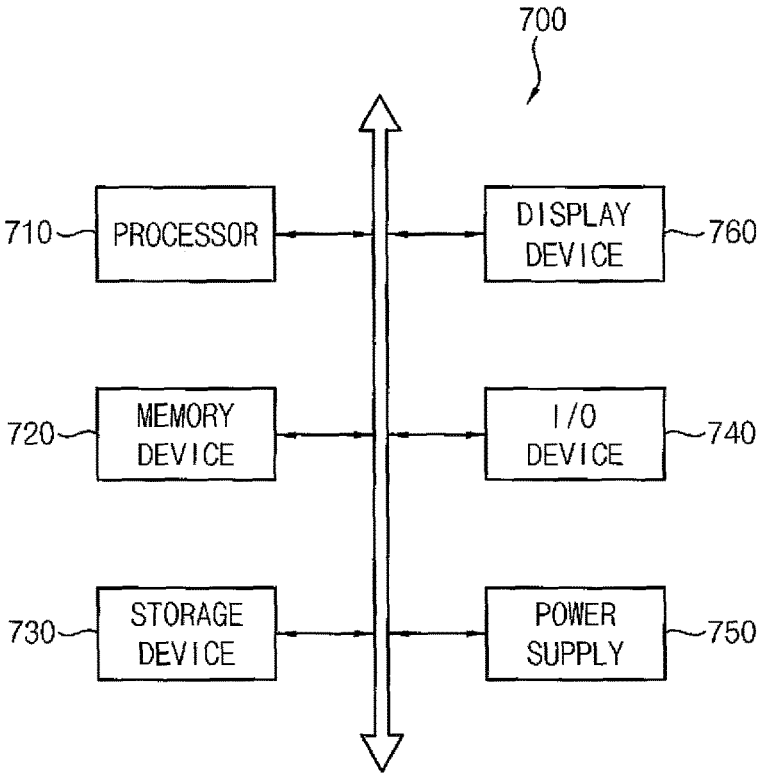
FIG. 14 is a block diagram illustrating exemplary embodiments of a mobile device according to the invention.

FIG. 14 is a block diagram illustrating a mobile device according to exemplary embodiments.

Referring to FIG. 14, a mobile device 700 includes a processor 710, a memory device 720, a storage device 730, an input/output ("I/O") device 740, a power supply 750, and a display device (e.g., electroluminescent display device) 760. The mobile device 700 may further include a plurality of ports for communicating with a video card, a sound card, a memory card, a universal serial bus ("USB") device, or other electronic systems.

The processor 710 may perform various computing functions or tasks. The processor 710 may be, for example, a microprocessor, a central processing unit ("CPU"), etc. The processor 710 may be connected to other components via an address bus, a control bus, a data bus, etc. Further, the processor 710 may be coupled to an extended bus such as a peripheral component interconnection ("PCI") bus.

The memory device 720 may store data for operations of the mobile device 700. In an exemplary embodiment, the memory device 720 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano-floating gate memory ("NFGM") device, a polymer random access memory ("PoRAM") device, a magnetic random access memory ("MRAM") device, a ferroelectric random access memory ("FRAM") device, and/or at least one volatile memory device such as a dynamic random access memory ("DRAM") device, a static random access memory ("SRAM") device, a mobile dynamic random access memory (mobile "DRAM") device, etc., for example.

In an exemplary embodiment, the storage device 730 may include, for example, a solid state drive ("SSD") device, a hard disk drive ("HDD") device, a CD-ROM device, etc. In an exemplary embodiment, the I/O device 740 may include, for example, an input device such as a keyboard, a keypad, a mouse, a touch screen, and/or an output device such as a printer, a speaker, etc. The power supply 750 may supply power for operating the mobile device 700. The electroluminescent display device 760 may communicate with other components via the buses or other communication links.

The illustrated embodiments may be applied to any mobile device or any computing device. The exemplary embodiments may be applied to a cellular phone, a smart phone, a tablet computer, a personal digital assistant ("PDA"), a portable multimedia player ("PMP"), a digital camera, a music player, a portable game console, a navigation system, a video phone, a personal computer ("PC"), a server computer, a workstation, a tablet computer, a laptop computer, etc., for example.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the inventive technology. Accordingly, all such modifications are intended to be included within the scope of the invention as defined in the claims. Therefore, it is to be understood that the foregoing is illustrative of various exemplary embodiments and is not to be construed as limited to the specific example embodiments disclosed, and that modifications to the disclosed exemplary embodiments, as well as other exemplary embodiments, are intended to be included within the scope of the appended claims.

What is claimed is:

1. A data compensation device comprising:

a current calculator which directly receives input data, a data enable signal, a horizontal synchronization signal and a vertical synchronization signal and calculates an average current of each of blocks included in a pixel array based on the input data, the data enable signal, the horizontal synchronization signal and the vertical synchronization signal, the horizontal synchronization signal and the vertical synchronization signal being used to divide the input data corresponding to each of the blocks;

a voltage drop info provider which provides a bus voltage drop information of predetermined bus points and an array voltage drop information of predetermined array points, the predetermined bus points being included in a power supply bus wiring which is connected to the pixel array, the predetermined array points being included in the pixel array;

a data compensation circuit which provides a compensation data corresponding to the input data based on the average current, the bus voltage drop information and the array voltage drop information; and an adder which provides a compensation result data by adding the input data and the compensation data.

2. The data compensation device of claim 1, wherein the voltage drop info provider includes:

a first look-up table which stores the bus voltage drop information of the predetermined bus points included in the power supply bus wiring; and a second look-up table which stores the array voltage drop information of the predetermined array points included in the pixel array.

3. The data compensation device of claim 2, wherein the bus voltage drop information is a voltage drop value of the predetermined bus points by a unit current which is provided to each of the blocks, and wherein the array voltage drop information is a voltage drop value of the predetermined array points by the unit current which is provided to each of the blocks.

4. The data compensation device of claim 2, wherein the data compensation circuit includes:

a voltage drop calculator which calculates a block voltage drop value of each of the blocks based on the average current, the bus voltage drop information and the array voltage drop information;

an interpolator which calculates a pixel voltage drop value of each of pixels included in each of the blocks according to the block voltage drop value; and a data compensator which provides the compensation data compensating the input data corresponding to each of the pixels based on the pixel voltage drop value.

5. The data compensation device of claim 4, wherein the voltage drop calculator calculates a bus voltage drop value which is a voltage drop in the predetermined bus points based on the average current and the bus voltage drop information.

6. The data compensation device of claim 5, wherein the voltage drop calculator calculates an array voltage drop value which is a voltage drop in the predetermined array points based on the average current and the array voltage drop information.

7. The data compensation device of claim 6, wherein the block voltage drop value is a sum of the bus voltage drop value and the array voltage drop value.

8. The data compensation device of claim 7, wherein the voltage drop calculator includes a block voltage drop register storing the block voltage drop value.

9. The data compensation device of claim 4, wherein the interpolator calculates the pixel voltage drop value of each of the pixels included in adjacent blocks among the blocks based on the block voltage drop value of the adjacent blocks.

10. The data compensation device of claim 4, wherein the current calculator includes:

an average current calculation circuit which calculates the average current of each of the blocks; and an average current register which stores the average current.

11. The data compensation device of claim 10, wherein the average current is updated based on the vertical synchronization signal.

12. The data compensation device of claim 11, wherein the average current is updated each frame which is determined according to the vertical synchronization signal.

13. The data compensation device of claim 4, wherein the data compensator includes:

a reference value provider which provides a reference voltage drop value of each of the pixels included in the blocks; and a compensation circuit which provides the compensation data based on the pixel voltage drop value and the reference voltage drop value.

14. The data compensation device of claim 13, wherein the reference value provider includes a reference look-up table storing the reference voltage drop value.

15. The data compensation device of claim 14, wherein the reference voltage drop value is stored in the reference look-up table before the data compensation device operates.

16. The data compensation device of claim 13, wherein the compensation data corresponds to a difference between the pixel voltage drop value and the reference voltage drop value.

17. The data compensation device of claim 1, wherein the blocks are determined based on a number of pixels included in the pixel array.

18. A display device comprising:

a current calculator which directly receives input data, a data enable signal, a horizontal synchronization signal and a vertical synchronization signal and calculates an average current of each of blocks included in a pixel array based on the input data, the data enable signal, the horizontal synchronization signal and the vertical synchronization signal, the horizontal synchronization signal and the vertical synchronization signal being used to divide the input data corresponding to each of the blocks;

a voltage drop info provider which provides a bus voltage drop information of predetermined bus points and an array voltage drop information of predetermined array points, the predetermined bus points being included in a power supply bus wiring which is connected to the pixel array, the predetermined array points being included in the pixel array;

a data compensation circuit which provides a compensation data corresponding to the input data based on the average current, the bus voltage drop information and the array voltage drop information;

an adder which provides a compensation result data by adding the input data and the compensation data; and a pixel array which displays the compensation result data.

19. The display device of claim 18, wherein the voltage drop info provider includes:

a first look-up table which stores the bus voltage drop information of the predetermined bus points included in the power supply bus wiring; and a second look-up table which stores the array voltage drop information of the predetermined array points included in the pixel array, and wherein the bus voltage drop information and the array voltage drop information are stored in the first look-up table and the second look-up table before the display device operates.

20. The display device of claim 18, wherein the data compensation circuit includes:

a voltage drop calculator which calculates a block voltage drop value of each of the blocks based on the average current, the bus voltage drop information and the array voltage drop information;

an interpolator which calculates a pixel voltage drop value of each of pixels included in each of the blocks according to the block voltage drop value; and a data compensator which provides the compensation data compensating the input data corresponding to each of the pixels based on the pixel voltage drop value.

* * * * *